US007284954B2

(12) United States Patent
Parker et al.

(10) Patent No.: US 7,284,954 B2
(45) Date of Patent: Oct. 23, 2007

(54) SHROUD BLOCK WITH ENHANCED COOLING

(76) Inventors: David G. Parker, 248 Riverside Dr., Palm Beach Gardens, FL (US) 33410; Robert P. Moore, 2688 SW. Bear Paw Trail, Palm City, FL (US) 34990; Charles Ellis, 1809 NW. Bright River Point, Stuart, FL (US) 34994

( * ) Notice: Subject to any disclaimer, the term of this patent is extended or adjusted under 35 U.S.C. 154(b) by 154 days.

(21) Appl. No.: 10/906,377

(22) Filed: Feb. 17, 2005

(65) Prior Publication Data

US 2006/0182622 A1 Aug. 17, 2006

(51) Int. Cl.
*F01D 25/12* (2006.01)

(52) U.S. Cl. ..... 415/173.1; 416/191

(58) Field of Classification Search ..... 415/115, 415/116, 173.1, 173.6; 416/189, 191, 192
See application file for complete search history.

(56) References Cited

U.S. PATENT DOCUMENTS

| | | | | |
|---|---|---|---|---|
| 4,013,376 | A | 3/1977 | Bisson et al. | |
| 4,752,184 | A | 6/1988 | Liang | |
| 5,486,090 | A * | 1/1996 | Thompson et al. | 415/173.1 |
| 6,126,389 | A * | 10/2000 | Burdgick | 415/115 |
| 6,340,285 | B1 * | 1/2002 | Gonyou et al. | 415/116 |
| 6,393,331 | B1 | 5/2002 | Chetta et al. | |
| 7,033,138 | B2 * | 4/2006 | Tomita et al. | 415/139 |

* cited by examiner

*Primary Examiner*—Ninh H. Nguyen

(57) ABSTRACT

A shroud for surrounding a portion of a turbine flow path having improved cooling and durability is disclosed. The shroud includes a plurality of generally axial cooling holes spaced a substantially equal distance apart and a plurality of generally circumferential cooling holes oriented generally perpendicular to the generally axial cooling holes. The generally circumferentially cooling holes are spaced a non-uniform distance apart so as to provide cooling to selected portions of shroud sidewalls to lower shroud operating temperatures and improve shroud durability.

14 Claims, 3 Drawing Sheets

SHROUD BLOCK WITH ENHANCED COOLING

BACKGROUND OF THE INVENTION

This invention generally relates to gas turbine engines and more specifically to a shroud section that surrounds a stage of rotating airfoils in the turbine of a gas turbine engine.

A gas turbine engine typically comprises a multi-stage compressor, which compresses air drawn into the engine to a higher pressure and temperature. A majority of this air passes to the combustors, which mix the compressed heated air with fuel and contain the resulting reaction that generates the hot combustion gases. These gases then pass through a multi-stage turbine, which drives the compressor, before exiting the engine. A portion of the compressed air from the compressor bypasses the combustors and is used to cool the turbine blades and vanes that are continuously exposed to the hot gases of the combustors. In land-based gas turbines, the turbine is also coupled to a generator for generating electricity.

In the turbine section of the engine, alternating stages of rotating and stationary airfoils are present through which the hot combustion gases expand as they turn the rotating stages of the turbine. In order to maximize the performance of the turbine, it is critical to maximize the amount of hot combustion gases passing through the airfoils, and not leaking around the airfoils, nor being used to cool the airfoils. To prevent leakage around stages of rotating airfoils, or turbine blades, shroud segments are used that conform to the radial profile of the turbine stage and are sized such that when the blade is rotating and at its operating temperature, the gap between the turbine blade tip and the shroud segment is minimized.

Given that operating temperatures within the turbine typically exceed 2000 degrees F. it is necessary to provide a source of cooling to the blades, vanes, and shroud segments adjacent the rotating blades so that these components are maintained within their material operating limits. Of particular concern with respect to the present invention is cooling of the shroud segments that encompass the rotating turbine blades. However, while it is necessary to cool the shroud segments, any air directed to cool the shroud segments does not pass through the turbine, thereby reducing the turbine efficiency. It is imperative that this cooling air, which is typically drawn from the engine compressor, be a minimal amount and used most effectively to cool as much of the exposed shroud surface as possible. An example of a shroud segment for a gas turbine engine employing a form of cooling of the prior art is shown in perspective view in FIG. 1. Shroud 10 includes an inner surface 11 that faces directly towards the tips of the rotating turbine blades (not shown) and an outer surface 12 in spaced relation to inner surface 11. Extending axially through the shroud thickness between inner surface 11 and outer surface 12 and exiting from shroud aft face 13 is a plurality of cooling holes 14. A cooling fluid, such as compressed air, enters cooling holes 14 from air inlets 15 and cools the shroud 10 as it passes through cooling holes 14. In this configuration, the edges 16 and 17 of shroud 10 do not receive any dedicated cooling. Shrouds are typically segmented, creating edges 16 and 17, in order to allow for differing thermal expansion between shroud 10 and the engine case in which the shrouds are mounted. Inspection of prior art shrouds having this cooling configuration indicate excessive heat load along edges 16 and 17, especially along the axial region of shroud 10 where the turbine blade is located.

In order to overcome the shortfalls of the prior art shroud design, it is necessary to provide a shroud for a gas turbine engine which addresses the heat load issues found in the prior art design, including providing sufficient cooling to the edges of the turbine shroud. Providing sufficient cooling to the edge regions where it is most needed will ensure that the heat load is reduced in the effected areas thereby extending the life of turbine shroud segments.

SUMMARY OF THE INVENTION

The present invention provides an improved shroud that is designed to surround a portion of a turbine. The shroud comprises first and second contoured surfaces, forward and aft faces, and first and second sidewalls. The shroud also comprises a plurality of generally axial cooling holes extending through the shroud thickness and a plurality of generally circumferential cooling holes oriented generally perpendicular to the axial cooling holes. The generally circumferential cooling holes are spaced a non-uniform distance apart so as to provide cooling to selected portions of first and second sidewalls. For the preferred embodiment generally circumferential cooling holes are concentrated higher proximate the axial position of the turbine blade, which imparts the highest heat load to the shroud. The generally axial cooling holes receive their cooling fluid preferably from a plurality of first feed holes, with each feed hole supplying the cooling fluid to an individual generally axial cooling hole. As for the plurality of generally circumferential cooling holes, they receive the cooling fluid preferably from a plurality of openings where each opening directs cooling fluid to multiple circumferential holes. It is preferred that the cooling fluid is air. However, other fluids may be used if available and desirable.

The present invention overcomes the shortfalls of the prior art by providing a shroud configuration that provides enhanced and dedicated cooling to previously un-cooled regions of the turbine shroud, specifically the shroud sidewalls. Furthermore, the circumferential cooling holes are spaced such that additional cooling air is directed to the highest temperature regions of the shroud in order to maximize the cooling efficiency.

DETAILED DESCRIPTION OF THE PREFERRED EMBODIMENT

Figure 1:
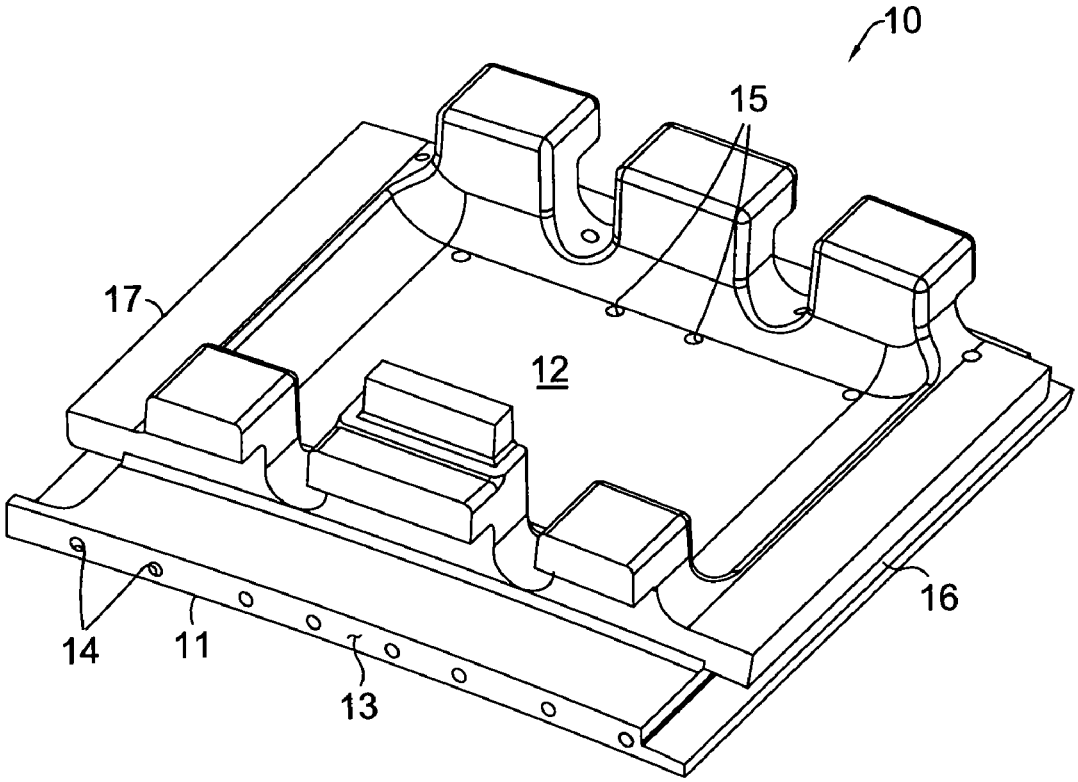
FIG. 1. PRIOR ART
FIG. 1 is a perspective view of a turbine shroud of the prior art.
Figure 2:
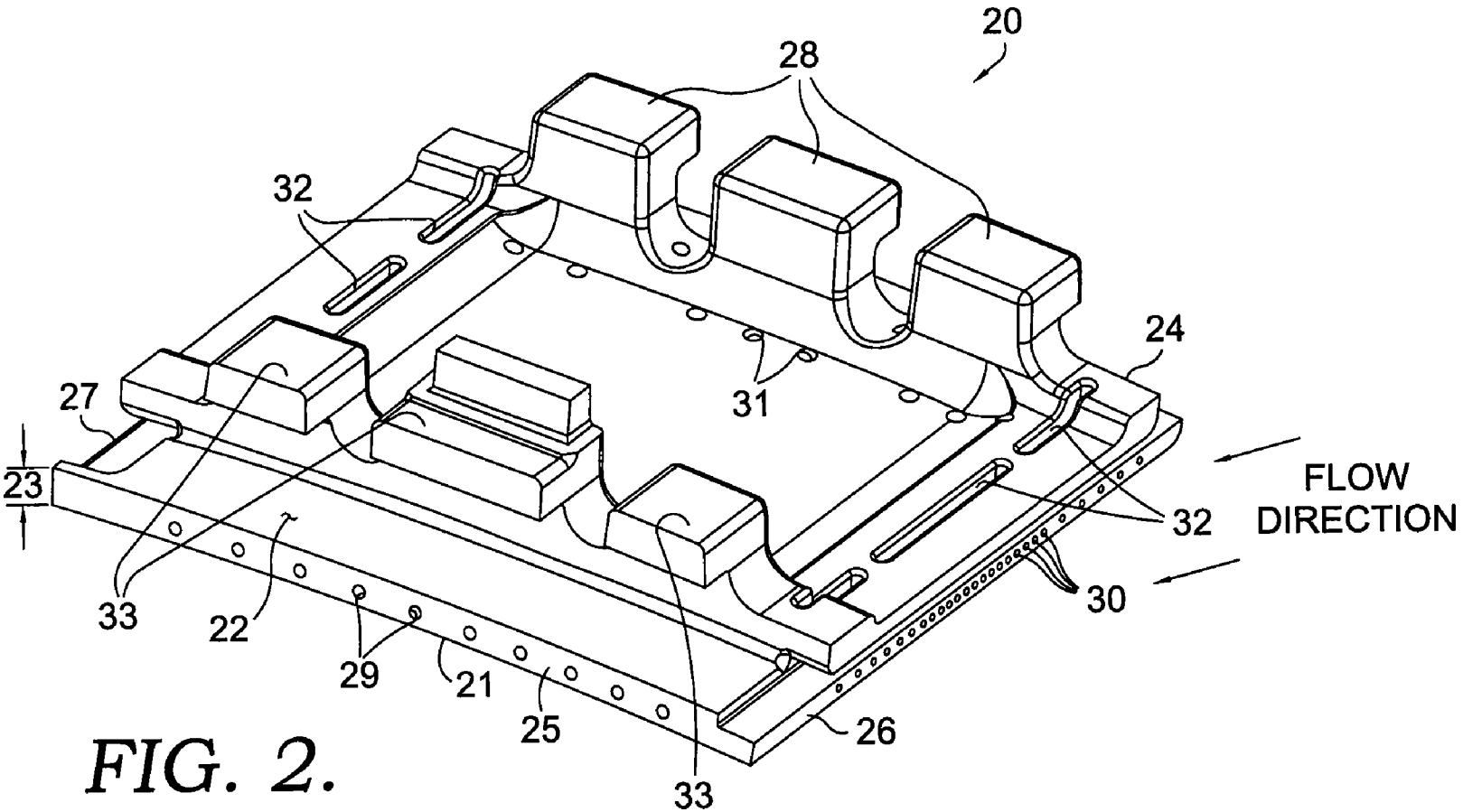
FIG. 2 is a perspective view of a turbine shroud in accordance with the preferred embodiment of the present invention.
Figure 3:
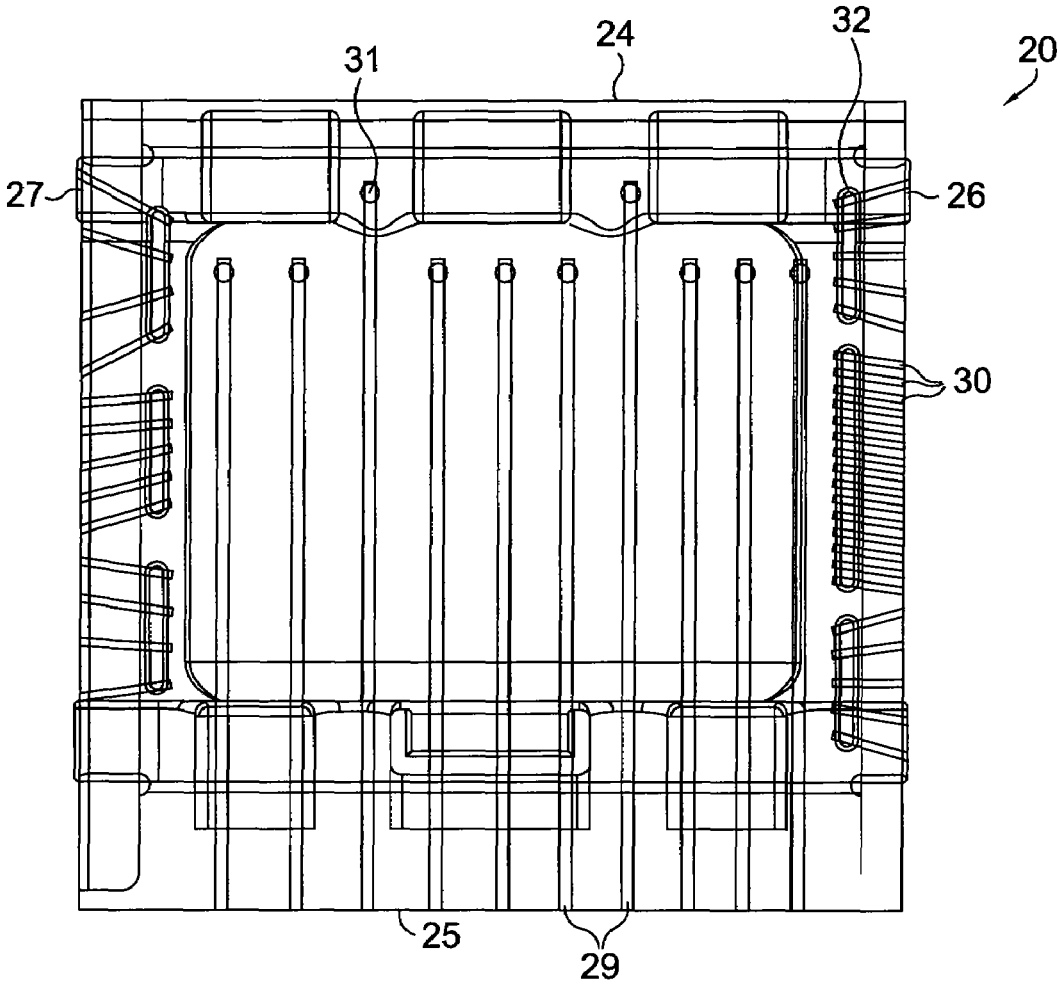
FIG. 3 is a section view of a turbine shroud in accordance with the preferred embodiment of the present invention.

The preferred embodiment will now be described in detail with specific reference to FIGS. 2 and 3. A shroud 20 for surrounding a portion of a gas turbine engine flow path is shown in perspective view in FIG. 2 and in a section view in FIG. 3. Shroud 20 comprises a number of features including a first surface 21 having a first contour and a second surface 22 having a second contour with second surface 22 located radially outward of first surface 21 thereby establishing thickness 23 therebetween. First contour and second contour are defined by the diameter of the turbine enclosed by shrouds 20, and will therefore vary in size by design. Shroud 20 further comprises forward face 24 and aft face 25, which are spaced in axial relation and extend radially between first surface 21 and second surface 22. Extending generally axially between forward face 24 and aft face 25 and spaced in circumferential relation are first sidewall 26 and second sidewall 27. An additional feature of shroud 20 is a first row of hooks 28 that extend radially outward from second surface 22 proximate forward face 24. A plurality of hooks is used in order to secure the shroud to an engine casing that surrounds the turbine section. Typically for structural integrity, hooks 28 are formed integral with shroud 20. It is common practice in the gas turbine industry to investment cast shrouds 20, including hooks 28, and then machine in other features of shroud 20. One such feature typically machined into a cast shroud is plurality of generally axial cooling holes 29, which for shroud 20 extend generally axially through the shroud from proximate first row of hooks 28 to aft face 25 and are preferably spaced a substantially equal distance apart.

An improvement of the present invention to shroud 20 is a plurality of generally circumferential cooling holes 30 that are oriented generally perpendicular to plurality of generally axial cooling holes 29. Plurality of generally circumferential cooling holes 30 are spaced a non-uniform distance apart to provide dedicated cooling to regions of first sidewall 26 and second sidewall 27. An especially high heat load is subjected to shroud 20 proximate first sidewall 26 compared to that of second sidewall 27. This is due to the direction from which the upstream turbine vanes direct the hot combustion gases onto the turbine blades within shrouds 20. For this particular shroud design, hot gases are directed from upstream turbine vanes at angle from the forward face 24 and first sidewall 26 towards the aft face 25 and second sidewall 27 (see arrows in FIG. 2 for flow direction). As a result more cooling holes 30 are required along first sidewall 26 than second sidewall 27. For this particular shroud, twice as many cooling holes 30 of equal diameter are required for first sidewall 26. As one skilled in the art of turbine cooling will understand, the exact quantity and size of cooling holes 30 are a function of the cooling required, available cooling air, and operating conditions. A cooling fluid, preferably compressed air, flows through generally axial cooling holes 29 and generally circumferential cooling holes 30. The cooling fluid is directed to generally axial cooling holes 29 by a plurality of first feed holes 31 in second surface 22.

An additional feature of shroud 20 is plurality of openings 32 located in second surface 22. Each of plurality of openings 32 has an axial length and a circumferential width with the axial length being greater than the circumferential width. Openings 32 are sized such that each opening is in fluid communication with multiple circumferential cooling holes 30. The quantity of openings 32 can vary depending on the size of shroud 20 and the quantity of circumferential cooling holes 30 that are fed a cooling fluid from opening 32. For the preferred embodiment disclosed in the present invention, three openings proximate both first sidewall 26 and second sidewall 27 are utilized. Depending on the size of openings 32 and shroud geometry, openings 32 can be cast into shroud 20 or machined into shroud 20 while machining other features such as cooling holes 29 and 30. It is preferred that openings 32 are sized with the disclosed axial length and circumferential width relationship for cost and structural reasons. Specifically, it is more cost effective to machine slots into second surface 22 than to drill individual feed holes for directing cooling fluid to each of plurality of circumferential cooling holes 30. Furthermore, due to the close proximity of plurality of circumferential cooling holes 30, placing an individual feed hole for each circumferential cooling hole would introduce areas of high stress concentrations at the interface of the circumferential cooling hole and individual feed hole.

A further feature of shroud 20 in accordance with the preferred embodiment is a second row of hooks 33 that extend radially outward from second surface 22 proximate aft face 25. Both second row of hooks 33 and first row of hooks 28 preferably comprises three hooks as shown in FIG. 2. Hooks 28 and 33 are designed and spaced such that shroud 20 is held in place within the gas turbine engine by hooks 28 and 33.

The present invention as disclosed herein provides a turbine shroud geometry with improved cooling to regions of the shroud previously uncooled or inadequately cooled. Adequate cooling is especially important along regions of the shroud exposed to the high heat load created by passing rotating turbine blades.

While the invention has been described in what is known as presently the preferred embodiment, it is to be understood that the invention is not to be limited to the disclosed embodiment but, on the contrary, is intended to cover various modifications and equivalent arrangements within the scope of the following claims.

What is claimed is:

1. A shroud surrounding a portion of a turbine flow path in a gas turbine engine, said shroud comprising:

A first surface having a first contour;

A second surface having a second contour, said second surface located radially outward of said first surface thereby establishing a thickness therebetween, said second surface having a plurality of openings located therein;

A forward face and an aft face extending radially between said first and second surfaces, said forward face and said aft face in axial spaced relation;

A first sidewall and a second sidewall in circumferential spaced relation and extending generally axially from said forward face to said aft face;

A first row of hooks extending radially outward from said second surface proximate said forward face;

A plurality of generally axial cooling holes extending from proximate said first row of hooks to said aft face;

A plurality of generally circumferential cooling holes oriented generally perpendicular to said generally axial cooling holes; and, Wherein said generally circumferential cooling holes are spaced a non-uniform distance apart so as to provide additional cooling to selected portions of said sidewalls.

2. The shroud of claim 1 wherein a cooling fluid flows through said generally axial cooling holes and said generally circumferential cooling holes.

3. The shroud of claim 2 wherein said cooling fluid is compressed air.

4. The shroud of claim 2 wherein said generally axial cooling holes receive said cooling fluid from a plurality of first feed holes in said second surface.

5. The shroud of claim 4 wherein said plurality of openings has an axial length and a circumferential width and said axial length is greater than said circumferential width.

6. The shroud of claim 5 wherein each of said plurality of openings directs said cooling fluid to multiple circumferential cooling holes.

7. The shroud of claim 1 further comprising a second row of hooks extending radially outward from said second surface proximate said aft face.

8. The shroud of claim 7 wherein said first row of hooks and said second row of hooks each comprises three hooks.

9. The shroud of claim 1 wherein said generally axial cooling holes are spaced a substantially equal distance apart.

10. A shroud surrounding a portion of a turbine flow path in a gas turbine engine, said shroud comprising:

A first surface having a first contour;

A second surface having a second contour, said second surface located radially outward of said first surface thereby establishing a thickness therebetween A forward face and an aft face extending radially between said first and second surfaces, said forward face and said aft face in axial spaced relation;

A first sidewall and a second sidewall in circumferential spaced relation and extending generally axially from said forward face to said aft face;

A first row of hooks extending radially outward from said second surface proximate said forward face;

A plurality of generally circumferential cooling holes spaced a non-uniform distance apart so as to provide selective cooling to portions of said sidewalls; and wherein said second surface has a plurality of openings located therein that each direct said cooling fluid to multiple circumferential cooling holes.

11. The shroud of claim 10 wherein said cooling fluid is compressed air.

12. The shroud of claim 10 wherein said plurality of openings has an axial length and a circumferential width and said axial length is greater than said circumferential width.

13. The shroud of claim 10 further comprising a second row of hooks extending radially outward from said second surface proximate said aft face.

14. The shroud of claim 13 wherein said first row of hooks and said second row of hooks each comprises three hooks.

* * * * *